United States Patent [19]

Kataoka

[11] Patent Number: 4,775,086

[45] Date of Patent: Oct. 4, 1988

[54] TAKE-OUT/TAKE-UP TENSION CONTROL APPARATUS

[76] Inventor: Hiroshi Kataoka, 3686, Sangawacho, Iyomishima-shi, Ehime 799-04, Japan

[21] Appl. No.: 101,419

[22] Filed: Sep. 28, 1987

Related U.S. Application Data

[62] Division of Ser. No. 771,821, Sep. 3, 1985, Pat. No. 4,708,301.

[51] Int. Cl.[4] ..... B65H 23/02; B65H 77/00

[52] U.S. Cl. ..... 226/44; 242/75.51

[58] Field of Search ..... 226/42, 44; 318/6, 7; 242/75.5, 75.51, 75, 75.52

[56] References Cited

U.S. PATENT DOCUMENTS

| | | | |
|---|---|---|---|
| 3,322,315 | 5/1967 | Eberlin | 226/44 |
| 3,667,664 | 6/1972 | Schroeder | 226/44 |
| 3,912,145 | 10/1975 | Meihofer | 226/44 |
| 4,708,301 | 11/1987 | Kataoka | 242/75.51 |

*Primary Examiner*—David Werner

*Attorney, Agent, or Firm*—Oblon, Fisher, Spivak, McClelland, & Maier

[57] ABSTRACT

A sheet winding apparatus comprises a take-out roller provided with a tension controller and adapted to take out a sheet rolled by a rolling unit so that uniform tension is applied to the sheet over its entire width, a dancer roller provided with a drive control mechanism and adapted to properly control the take-up tension in the sheet being taken out and wind the sheet on a take-up reel.

8 Claims, 7 Drawing Sheets

TAKE-OUT/TAKE-UP TENSION CONTROL APPARATUS

This is a divisional application of U.S. patent application No. 771,821 filed on Sept. 3, 1985 now U.S. Pat. No. 4,708,301.

BACKGROUND OF THE INVENTION

1. Field of the Invention

This invention relates to a take-out tension control apparatus for controlling the take-out tension in a film or sheet being taken out from a stretching unit in a film or sheet production line by a take-out roller and also to a take-up tension apparatus for controlling the take-up tension in the stretched film or sheet as the film or sheet is wound into a roll on a take-up reel.

2. Related Art Statement

In the stretching apparatus of a stretched film or sheet production line, a plurality of pairs of clips are provided at predetermined intervals along the opposite edges of the film- or sheet-like synthetic resin work being stretched. These clip pairs grasp the opposite edges of the work as it proceeds and the distance between the clip pairs is gradually increased as the clips guide the work. In this way, the work is stretched into a film or sheet having a predetermined thickness as it is driven at a predetermined line speed in the direction of travel. The stretched film or sheet obtained in this way is taken out of the stretching apparatus by a take-out roller and is then fed to a take-up unit to be wound on a take-up reel. In the conventional arrangement, the take-out roller is rotated at the same peripheral speed as the line speed in the stretching apparatus. The take-up unit for winding up the stretched film or sheet taken out from the stretching apparatus is usually provided with a transmitted torque control means, e.g., a magnetic power clutch, provided between a pay-off roller drive motor and the take-up reel and controls the torque transmitted to the take-up reel to thereby control the take-up tension in the stretched film or sheet that is wound on the take-up reel.

The opposite edges of the film or sheet being stretched as it proceeds through the stretching unit are grasped and restricted by the clips. However, the central portion of the film or sheet running through the space is not directly restricted from the outside. When the film or sheet in this state is taken out by the take-out roller, the film or sheet in the stretching unit is subject to the influence of the take-out tension because the stretching unit does not have a function of shutting out the take-out tension produced by the take-out roller.

If the take-out tension is proper, the film or sheet can be stretched uniformly over its entire width without distortion or thickness fluctuations in the width direction. When the take-out tension is excessive, however, the film or sheet tends to be stretched to a greater extent toward the central portion as shown in FIG. 1. On the other hand, when the take-out tension is insufficient, the film or sheet tends to be stretched to a greater extent toward the edges as shown in FIG. 2.

When a film or sheet stretched non-uniformly is once wound into a roll and then rewound into a plurality of narrower rolls while being longitudinally slit, the rewound rolls are apt to exhibit thickness fluctuations and local sagging, e.g. edge sagging or center sagging. If the degree of the fluctuation and/or sagging is pronounced, the stretched film or sheet will not be suitable as a commercial product. Further, the individual rolls produced by slitting and rewinding a non-uniformly stretched film or sheet are apt to suffer wrinkling and non-uniform distribution of tension so that it is difficult to obtain a high quality roll. It is found that the quality of the stretched film or sheet is influenced not only by the performance of the stretching unit but also by the take-out tension applied by the take-out roller to the stretched film or sheet issuing from the stretching unit. The take-out tension, therefore, has to be controlled to a proper level in order to improve the quality of the stretched film or sheet.

The prior art take-out roller, however, is rotated at a peripheral speed equal to the line speed in the stretching unit and does not have any tension control function. In other words, control for assuring uniform thickness of the stretched film or sheet is undertaken only in the stretching unit. Such control is insufficient for obtaining a stretched film or sheet of high quality.

Moreover, the proper take-out tension varies with the prescribed thickness of the film or sheet to be stretched by the stretching unit. Further, when the take-out roller driven for rotation at a fixed speed, the difference between the line speed and the peripheral speed of the take-out roller directly leads to elongation or contraction of the film or sheet in the direction of travel. Therefore, even though the difference may be very small, it will greatly affect the tension in the film or sheet.

For this reason, even when used in combination with a stretching unit providing excellent performance, a prior art in-line winder lacking take-out tension control capability cannot sufficiently cope with the thickness fluctuations and local sagging of the film or sheet, so that the number of rejectable products is large.

Further, there has recently arisen a need to manufacture very thin films with thicknesses ranging from several tens of microns down to several microns. Such very thin films are stretched with low tension, which makes it even more difficult to stretch these thin films uniformly in the width direction. Therefore, thickness fluctuations and local distortion of the film are produced, causing local sagging of the film and other such defects and reducing the product yield.

In many cases, the defects inherent in the film taken up with the in-line winder appear as sagging or the like only in the ensuing slitting and rewinding process. This results not only in a large number of rejects but also in the loss of the time and labor spent for rewinding.

Furthermore, the film or sheet taken out from the stretching unit has a large width, and this wide film or sheet must be taken up into a large diameter roll. Such a large diameter roll has a large weight. Further, the recent trend is toward producing very thin stretched films with the stretching unit and these films are also taken up as large diameter rolls. For example, when a polyester film with a thickness of 12 microns and a width of 6 m is wound into a roll with an outer diameter of 1.2 m, the weight of this roll is approximately 6 tons.

However, the smaller the thickness of the film or sheet, the lower must be the take-up tension. The elongation of the film or sheet caused at the time of winding due to the take-up tension will cause shrinkage of the roll after winding. This will produce a permanent strain in the film or sheet and is cause for rejected products. The take-up tension in the film or sheet, therefore, is desirably as low as possible so far as such shape defects as irregular roll ends are not produced. For example, when winding a 12-micron thick, 6-meter wide film as noted above, the take-up tension is preferably controlled to be about 10 kg or less over the entire width. If the radius of the roll at this time is 0.6 m, the take-up torque may be very low, e.g., 6 kgm.

It is thus necessary to wind the film or sheet into a roll which is as heavy as 6 tons and has a great momentum with a very low take-up tension of about 10 kg.

Where such a heavy roll of film or sheet is produced with low take-up tension, the momentum of the roll being produced and the frictional loss of the required large-size take-up reel drive mechanism greatly affect the required take-up reel torque. Therefore, smooth and accurate control of the low take-up tension in the film or sheet can not obtained through control of the take-up reel torque.

For the above reasons, the prior art take-up apparatus of the type where the take-up tension is controlled through control of the take-up reel torque is not able to take up a film or sheet into a heavy roll with a low take-up tension and with a sufficiently high winding quality. This is especially true in the case of the very thin films being produced nowadays.

OBJECT AND SUMMARY OF THE INVENTION

An object of the invention is to provide a take-up apparatus which takes out a stretched film or sheet from a stretching unit while applying optimum tension to the film or sheet uniformly in the width direction thereof so that the film or sheet is stretched uniformly in the width direction in the stretching unit and then winds the film or sheet into a roll under proper take-up tension.

To attain this object, in accordance with the invention a take-out unit for taking out the stretched film or sheet from the stretching unit by use of a take-out roller driven by drive means is provided with a tension controller for controlling the tension in the film or sheet being taken out.

The tension controller is capable of controlling the take-out tension so that the film or sheet passing through the stretching unit with only its edges gripped by clips can be given a uniform tension in the width direction through control of the take-out tension.

Further, the invention makes it possible to eliminate thickness fluctuations in the film or sheet thickness which would otherwise arise due to lack of uniformity in tension distribution in the direction of travel and also to eliminate local sagging of the film or sheet, e.g. central sagging or edge sagging, due to strain in the film or sheet. As a result, even a film having a very small thickness can be produced with high quality.

Further, the invention provides a take-up unit having a dancer roller disposed in the running path of the film or sheet between a feed roller and a take-up reel for guiding the film or sheet along the path. The revolving rate of the take-up reel is controlled such that the dancer roller is returned to a reference position whenever it is displaced therefrom. Also, the film or sheet being wound into a roll is given a proper tension for the control of the force applied to the dancer roller against the tension in the film or sheet.

The control of the take-up tension is carried out by setting a take-up tension pattern in a drive force controller of a drive mechanism for controlling the force applied to the dancer roller against the tension in the film or sheet.

Where the take-up tension is controlled through control of the torque applied to the take-up reel, the take-up tension is liable to become inaccurate due to the momentum of the roll and like causes. According to the invention, the dancer roller can be moved lightly, and the take-up tension is controlled through control of the force applied to the dancer roller against the tension in the film or sheet, so that accurate take-up tension control can be obtained. Further, even when the tension in the running film or sheet varies due to an external disturbance, the dancer roller is displaced to follow and absorb the tension variations. Thus, accurate take-up tension can be ensured even when a film or sheet is wound into a very large diameter roll with a very low take-up tension. Also, a very thin film or sheet which can be readily stretched can be wound into a high quality roll.

BRIEF DESCRIPTION OF THE DRAWINGS

The above and other objects and features of the invention will become more apparent from the following description with reference to the accompanying drawings, in which.

DESCRIPTION OF THE PREFERRED EMBODIMENT

Figure 1:
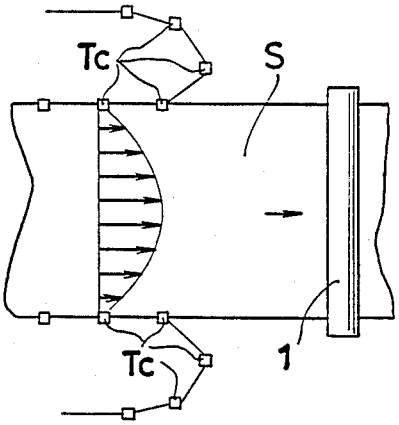
FIG. 1 is a schematic view illustrating the manner in which a film or sheet is stretched when the peripheral speed of a take-out roller is higher than the line speed of a stretching unit.
Figure 2:
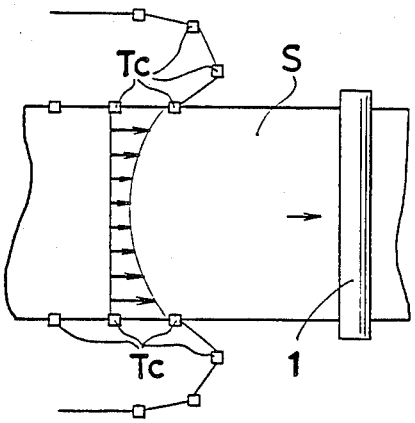
FIG. 2 is a schematic view illustrating the manner in which the film or sheet is stretched when the peripheral speed of the take-out roller is lower than the line speed of the stretching unit.
Figure 3:
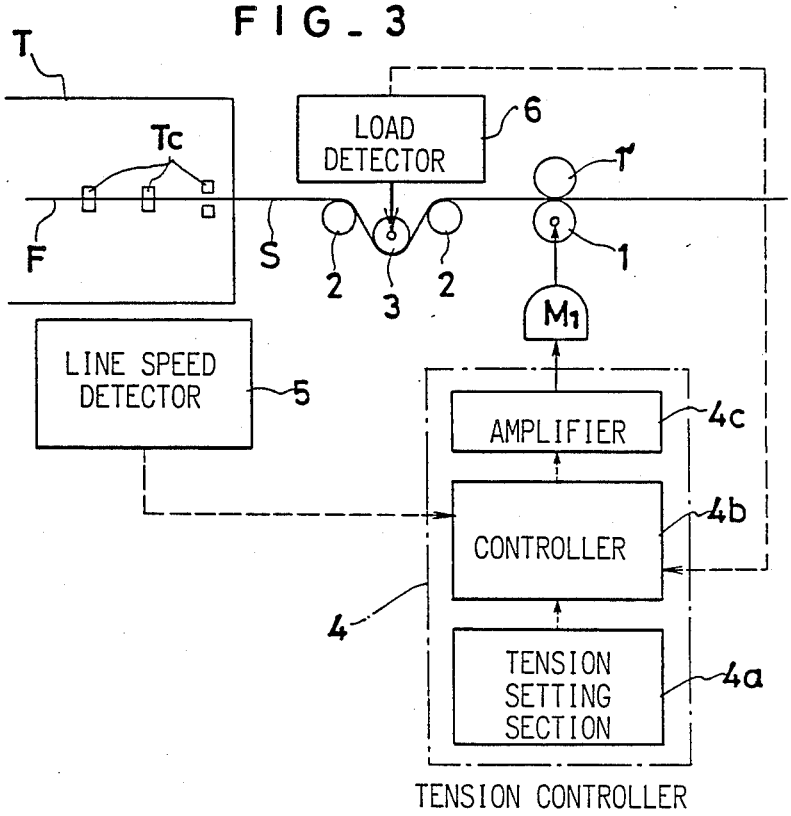
FIG. 3 is a schematic representation of a first embodiment of the take-out tension control apparatus according to the invention for controlling the tension in a film or sheet between a stretching unit and a take-out roller.

FIG. 3 shows a first embodiment of the take-out tension control apparatus for controlling the tension in a stretched film or sheet being taken out from a rolling unit by a take-out roller.

Reference symbol T designates a stretching unit. A film- or sheet-like work S supplied to the stretching unit T is rolled to a predetermined thickness as it is fed through the stretching unit T with its opposite edges gripped by grippers Tc arranged at predetermined intervals. The rolled film or sheet (hereinafter referred to simply as sheet) S is continuously taken out from the rolling unit T.

The stretched sheet S is taken out from the rolling unit T by a take-out roller 1, which is rotated at a predetermined speed by a motor M1, via a first guide roller 2, a tension detection roller 3 and a second guide roller 2. In this embodiment, a nip roller 1' is provided to urge the sheet S against the take-out roller 1 so as to increase the frictional force between the take-out roller and sheet so that the sheet can be reliably taken out by the take-out roller. The nip roller may be omitted if sheets can be reliably taken out by the take-out roller alone. Further, the take-out roller 1 may be mounted on the frame of the stretching unit, or it may be mounted on the frame of a separate take-out or winding unit. The stretching unit may be of any type so long as it has the function of stretching the sheet-like work while maintaining clips in engagement with both the edges of the work.

A tension controller 4 controls the tension in the stretched sheet S between the stretching unit T and take-out roller 1. It includes a tension setting section 4*a*, a controller 4*b* and an amplifier 4*c*. The desired take-out tension is set in the tension setting section 4*a*. In the tension setting section 4*a* the tension is set, for instance, such that the thickness of the sheet S taken out of the stretching unit as measured by a thickness gauge is maintained uniform in the width direction of the sheet or such that a straight line drawn in advance on the sheet-like work is maintained as such while the work is being stretched. A tension signal representing the tension set in the tension setting section 4*a* is fed to the controller 4*b*. In the controller 4*b*, the preset tension signal from the tension setting section 4*a* is compared with a detected tension signal from a load detector 6, which converts the force exerted on the tension detection roller 3 by the tension in the sheet into an electric signal. The controller 4*b* produces a difference signal representing the difference between the preset tension signal and detected tension signal and this difference signal is compared with a line speed signal from a line speed detector 5 provided in the stretching unit T. The resulting difference signal is fed as a speed command signal to the amplifier 4*c*. The amplifier 4*c* amplifies the signal from the controller 4*b* to produce a signal which is fed to the motor M1, whereby the take-out roller 1 is rotated with such torque and at such rotational speed that the tension set in the tension setting section 4*a* is constantly maintained in the stretched sheet issuing from the stretching unit. The tension in the stretched sheet taken out of the stretching unit T is thus controlled to the preset value. Through such control of the tension of the stretched sheet taken out of the stretching unit T, the distribution of tension in the width direction of the sheet can be controlled so that stretching to a uniform thickness can be realized. The motor speed and motor torque can be controlled in any of various well-known methods.

Figure 4:
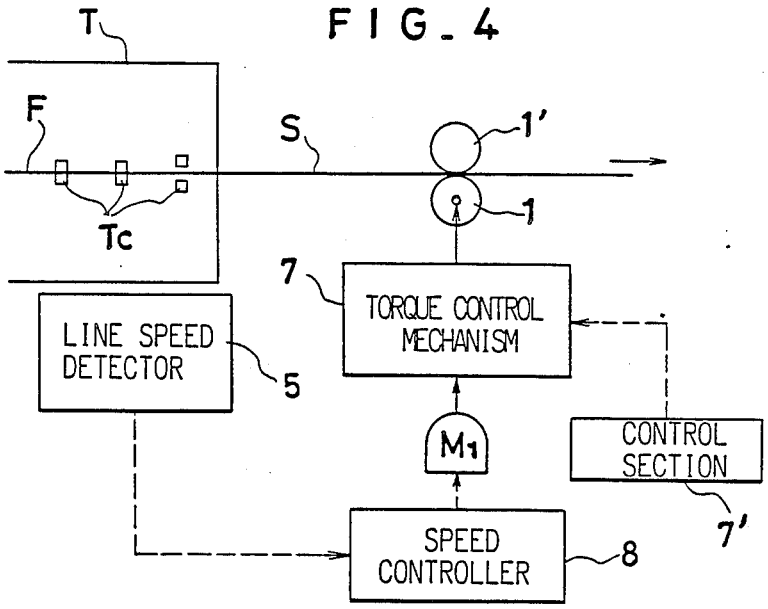
FIG. 4 is a schematic representation of a second embodiment of the take-out tension control apparatus.

FIG. 4 illustrates a second embodiment of the take-out tension control apparatus. In this instance, the take-out roller 1 is driven by the take-out roller drive motor M1 via a transmitted torque control mechanism 7. A speed controller 8 receives a line speed signal from the line speed detector 5 and controls the speed of the motor M1 such that the take-out roller 1 is rotated at a peripheral speed slightly lower than the line speed. The torque control mechanism 7 is constructed such that slip is produced between its input and output shafts while the torque of the motor M1 is being transmitted to the torque control mechanism 7. That is, slip is produced between the input and output shafts if the peripheral speed of the take-out roller 1 is higher than the line speed of the stretching unit T. The take-out roller is thus rotated at the same peripheral speed as the line speed so that the desired torque is transmitted to the take-out roller. The sheet S can thus be taken out under a tension corresponding to the torque of the take-out roller 1 without the possibility of loss of tension in the sheet S due to too low peripheral speed of the take-out roller compared with the line speed. The transmitted torque from the torque control mechanism 7 can be controlled by a take-out tension control section 7'. More specifically, the control section 7' can control the torque transmitted to the take-out roller 1 so as to maintain the tension in the sheet issuing from the stretching unit T at the level required to assure uniform thickness of the sheet S. The take-out tension control section 7' may use a friction clutch capable of continuous slip, e.g., a magnetic powder clutch, a hydraulic torque converter or the like. Further, where the transmitted torque control mechanism is capable of increasing the slip ratio between its input and output shafts, the take-out drive motor M1 may be a motor rotating at a constant speed.

Figure 5:
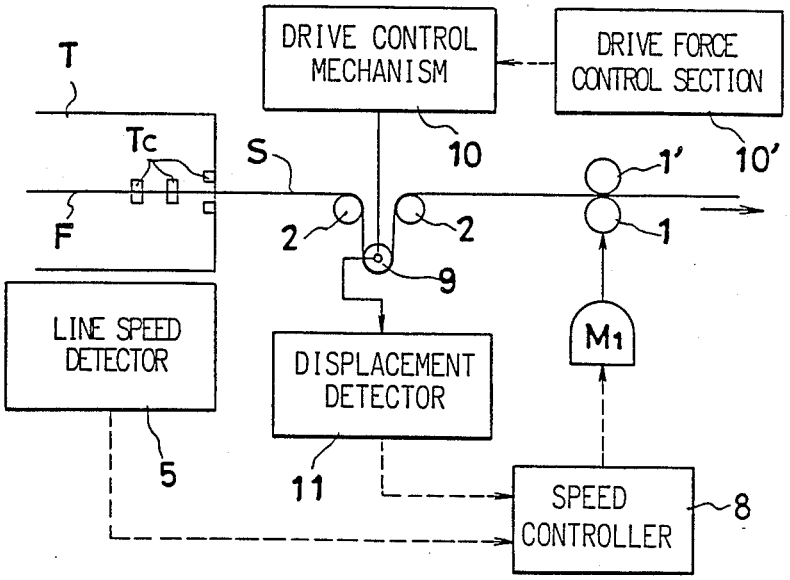
FIG. 5 is a schematic representation of a third embodiment of the take-out tension control apparatus.

FIG. 5 shows a third embodiment of the take-out tension control apparatus. In this case, a dancer roller 9 is provided between the two guide rollers 2 between the stretching unit T and the take-out roller 1 so as to be vertically displaceable according to variations in the tension in the stretched sheet S. When the dancer roller 9 is displaced downwards, the length of the running path of the rolled sheet is increased, while an upward displacement of the dancer roller 9 reduces the length of the running path. In this embodiment, a lifting force is applied to the dancer roller 9 by a drive control mechanism 10 comprising a pnuematic cylinder. When this lifting force is smaller than the weight of the dancer roller 9, the dancer roller desends thus increasing the length of the running path of the stretched sheets S.

The magnitude of the drive force (i.e., lifting force) provided by the drive control mechanism 10 can be varied by operating a drive force control section 10' (which comprises a regulator valve). Since the weight of the dancer roller 9 is fixed, the downward displacement of the dancer roller 9 can be controlled through control of the drive force of the drive control mechanism 10.

The displacement of the dancer roller 9 is detected by a displacement detector 11 which consists of a rotary or linear motion potentiometer or differential transformer. The output signal of the displacement detector 11 is fed to the speed controller 8 for controlling the speed of the take-out roller drive motor M1. The speed controller 8 compares the signal from the displacement detector 11 with a preset reference signal, and when the dancer roller is displaced due to a change in the tension of the stretched sheet or a change in the line speed, the speed controller 8 immediately produces a signal for returning the dancer roller to a reference position. This signal is compared with a line signal from the line speed detector 5 in the stretching unit T, and the resulting difference signalis fed as a correction signal after amplification to the drive motor M1 for controlling the rotational speed thereof.

More specifically, when the dancer roller is lowered, the speed at which the sheet is taken out is made higher than the speed at which the sheet is fed out from the stretching unit. Consequently, the length of the running path of the stretched sheet is reduced, so that the dancer roller is raised by the sheet passed round it. When the dancer roller is raised, the take-out speed is made lower than the feed-out speed. Consequently, the length of the running path of the stretched sheet is increased so that the dancer roller is lowered.

The dancer roller 9 is controlled to the reference position from positions within a permissible range. Therefore, it is held in a suspended state by the stretched sheet passed round it. The force acting on the dancer roller 9 in this state is the resultant of the downward force acting on the dancer roller, i.e. difference between the wieght thereof and the lifting force applied by the drive control mechanism, and the upward force applied to the dancer roller due to the tension in the stretched sheet guided by the dancer roller. Considering the balance of the forces acting on the dancer roller, the tension produced in the stretched sheet is such that the force tending to cause displacement of the dancer roller 9 downwardly, i.e., in the direction of increasing the length of the running path of the stretched sheet, and the upward force due to the tension in the rolled sheet are equal. Thus, the tension, i.e., the take-out tension, in the rolled sheet can be controlled through control of the force tending to cause downward displacement of the dancer roller. In this embodiment, the tension F in the rolled sheet that supports the dancer roller is one half the force F1 tending to cause the downward displacement of the dancer roller (i.e., force against the tension in the rolled sheet). The rolled sheet taken out from the stretching unit T is thus at all times given the proper take-out tension, which corresponds to the force tending to cause downward displacement of the dancer roller as controlled by the drive control mechanism 10, and the sheet in the stretching unit can be rolled to a uniform thickness.

The drive control mechanism 10 for the dancer roller 9 may be a hydraulic cylinder or may be of a type in which one end of a spring having the other end thereof coupled directly or indirectly to the dancer roller is varied either manually or with a hydraulic cylinder or a screw jack for the control of the tensile or compressive force of the spring. Further, it may be of a type utilizing a weight or the like.

Further, the direction in which the dancer roller is displaced is not limited to the vertical. Also, the dancer roller may be guided by a linear guide mechanism or by a pivotal guide mechanism which can rock about a support point. The displacement detector 11 for detecting the displacement of the dancer roller, may be detector which provides an electric signal representing the displacement of the dancer roller or may be a detector which provides a hydraulic pressure signal. Otherwise it may be a transmitting mechanism for merely mechanically transmitting the displacement of the speed controller. Further, the detection signal representing the displacement of the dancer roller may be compared directly with the line signal instead of comparing it with the reference signal.

As has been shown, the take-out tension control section controls the distribution of tension in the stretched sheet being taken out from the stretching unit through control of the take-out tension in the stretched sheet, so that a uniform tension distribution over the entire stretched sheet can be obtained, and a high quality stretched sheet having less variation in thickness can be obtained continuously.

Now, the control of the take-up tension in the stretched sheet when winding the sheet on a take-up reel will be described.

Figure 6:
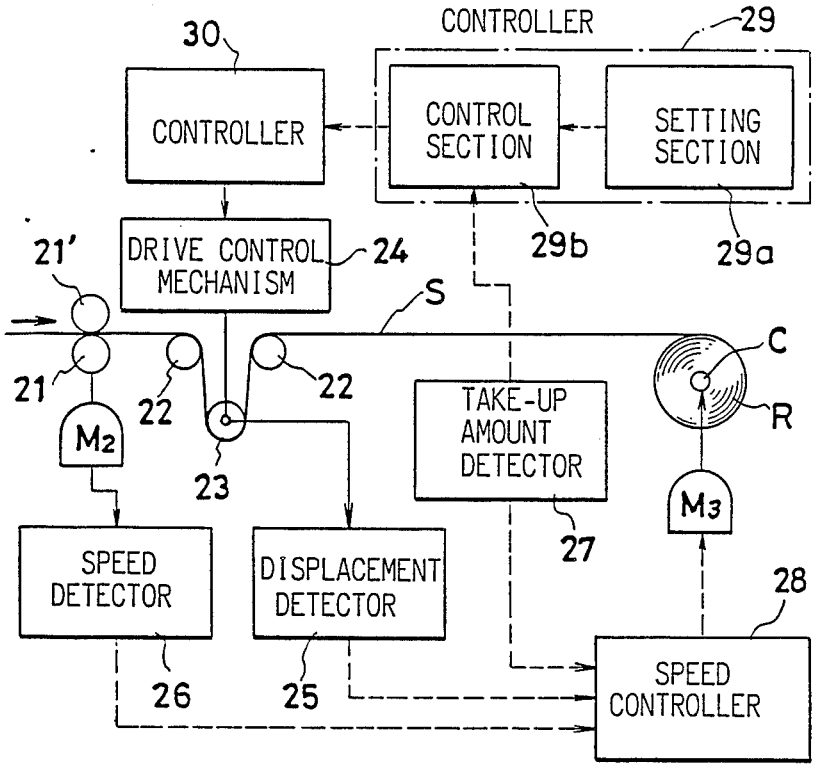
FIG. 6 is a schematic representation of a first embodiment of the take-up tension control apparatus according to the invention for controlling the tension in a film or sheet being wound into a roll.

FIG. 6 shows a first embodiment of the take-up tension control apparatus for controlling the tension in the stretched sheet being wound on a take-up reel.

The stretched sheet S taken out from the stretching unit by the take-out roller is fed by a feed roller 21 which is rotated at a predetermined speed by a drive motor M2 to proceed round a dancer roller 23 and be taken up as a sheet roll R on a take-up reel C rotated by a drive motor M3.

The dancer roller 23, like the dancer roller 9 in the embodiment shown in FIG. 5, is provided with a drive control mechanism 24 and a displacement detector 25, and it is possible to control the force tending to cause downward displacement of the dancer roller 23 and also detect changes in the dancer roller position.

The displacement signal from the displacement detector 25, a speed signal from a speed detector 26 for detecting the speed of the stretched sheet and an amount signal from an amount detector 27 for detecting the amount of the sheet having been taken up are fed to a speed controller 28.

The speed detector 26 may be of any type so long as it can detect the running speed of the stretched sheet. For example, it may be of a type which detects the rotational speed of the drive motor M2 with a speed generator, or it may be of a type which detects the peripheral speed of the feed roller 21. Further, it may be of a type which detects the speed of the feed roller 21 or the stretched sheet in a contactless manner.

The amount detector 27 may detect either the roll diameter or the length of the stretched sheet taken up. In the former case, the detector 27 may be of a type which uses a potentiometer to detect the angle of a pivotal support arm supporting a touch roller in contact with the roll. Alternatively, it may be of a type which calculates the sheet roll diameter from the running speed of the rolled sheet and the rotational speed of the take-up reel, of a type which calculates the sheet roll diameter from the total number of rotations and the thickness of the stretched sheet, or of a type which calculates the roll diameter from the length of the stretched sheet taken up and the thickness thereof. In the latter case, the amount detector 27 may comprise a pulse detector.

The revolving rate "n" of the take-up reel (i.e., roll) can be calculated as $$n = V/2\pi R$$

where V is the running speed of the stretched sheet and R is the radius of the roll being wound.

The speed controller 28 produces a signal representing the instantaneous revolving rate of the take-up reel corresponding to $n = V/2\pi R$ through division of an input signal representing the running speed of the stretched sheet by an input signal representing the roll diameter. The revolving rate signal is compared with a signal representing the displacement of the dancer roller to obtain a correction command signal, which is amplified before being fed to the take-up reel drive motor M3. Alternatively, the dancer roller displacement signal may be compared with a preset reference signal, and the resultant signal may be compared with the revolving rate signal to obtain a correction command signal which is amplified before being fed to the take-up reel drive motor M3. The take-up reel drive motor M3 receiving the correction command signal from the speed controller 28 drives the take-up reel C at such a speed that the dancer roller 23 is returned to a reference position when it is displaced therefrom due to a change in the tension in the stretched sheet or in the rotational speed of the feed roller 21. When the dancer roller 23 is displaced downwards from the reference position, the speed at which the stretched sheet is fed by the feed roller 21 is made higher than the speed at which the stretched sheet is wound into the roll R. Consequently, the length of the running path of the stretched sheet between the feed roller 1 and take-up reel C is reduced, so that the dancer roller 23 is raised. On the other hand, when the dancer roller is displaced upwards from the reference position, the feed speed is made higher than the take-up speed, so that the dancer roller 23 is lowered. Since the dancer roller 23 is controlled so that it is returned to the reference position when it is displaced therefrom either upwards or downwards to a position within the permissible range, it is held suspended by the stretched sheet passed round it. The tension, i.e, the take-out tension, in the stretched sheet can be controlled through control of the thrust provided by the drive control mechanism 24 as described before in connection with the embodiment shown in FIG. 5. The speed controller 28 obtains the instantaneous revolving rate of the take-up reel according to $n=V/2\pi R$ and corrects the obtained revolving rate according to the displacement of the dancer roller. Thus, the revolving rate of the take-up reel can be controlled to quickly follow changes in the running speed of the stretched sheet. It is alternatively possible to compare the speed signal representing the running speed of the stretched sheet and the dancer roller displacement signal and divide the resulting signal by the roll diameter signal to obtain the correction command signal.

The invention is not limited to the speed controller 28 in the above embodiment and other arrangements are possible insofar as the dancer roller 23 is controlled to be returned to the reference position whenever it is displaced therefrom. Further, the above embodiment of the take-up tension control apparatus is applicable to any take-up unit of the type in which the take-up reel is driven, irrespective of whether there is any touch roller and also irrespective of the mechanism for bringing the take-up reel and touch roller toward and away from each other. Further, instead of feeding the amount signal to the control section of the dancer roller drive control mechanism, the instantaneous take-up tension may be controlled in the drive control mechanism according to the lapse of take-up time.

In order to obtain a high quality roll of stretched sheet, the take-up tension must be controlled to a satisfactory value relative to the take-up amount characteristic, which varies with the growth of the roll.

For this purpose, a controller 29 including a setting section **29*a* and a control section 29*b* is provided, and a take-up tension pattern (i.e., take-up tension versus take-up amount characteristic) is set in the setting section 29*a* of the controller 29. The control section 29*b* calculates the instantaneous take-up tension according to the preset pattern signal from the setting section 29*a* and the take-up amount signal from the take-up amount detector 27 and also calculates the drive force of the drive control mechanism 24 for obtaining the necessary take-up tension, the drive force signal thus obtained being amplified and then fed to a controller 30. The controlling 30 receives the output signal of the control section 29*b* and controls the thrust of the drive control mechanism 24, thus controlling the downward force acting on the dancer roller 23**, i.e., the force tending to cause displacement of the dancer roller in the direction of increasing the length of the running path of the stretched sheet.

FIGS. 7 to 10 show examples of the drive control mechanism 24 for the dancer roller 23 and controller 30.

Figure 7:
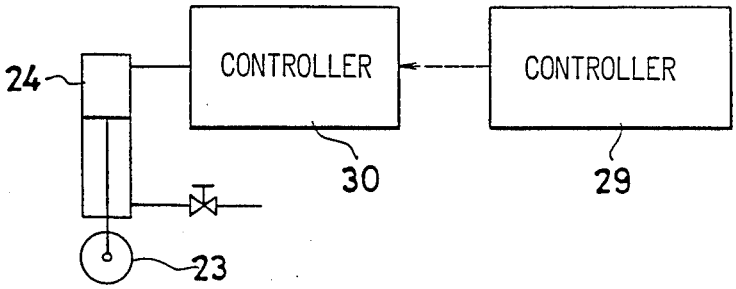
FIG. 7 is a schematic representation of a first example of a dancer roller drive control mechanism in the take-up tension control apparatus.

In the example of FIG. 7, the drive control mechanism 24 is an air cylinder, while the controller 30 is an electro-pnuematic converter. The controller 30 is not limited to use of the electro-pnuematic converter but instead can use a regulator valve with a pilot rotor or a like device capable of converting an electric signal into air pressure.

When the dancer roller 23 is displaced, the air cylinder is also displaced, but the air pressure in the air cylinder is controlled by the electro-pnuematic converter to be maintained substantially constant. A spring may be provided between the dancer roller 23 and the air cylinder 24. In this case, even if there is a cause of short-period variations in the take-up tension such as a deformation of the roll, the spring, via which the thrust of the drive control mechanism is transmitted to the dancer roller, permits quick and smooth displacement of the dancer roller irrespective of the frictional resistance between the cylinder and the piston and rod of the air cylinder, thus suppressing variation in the take-up tension.

Figure 8:
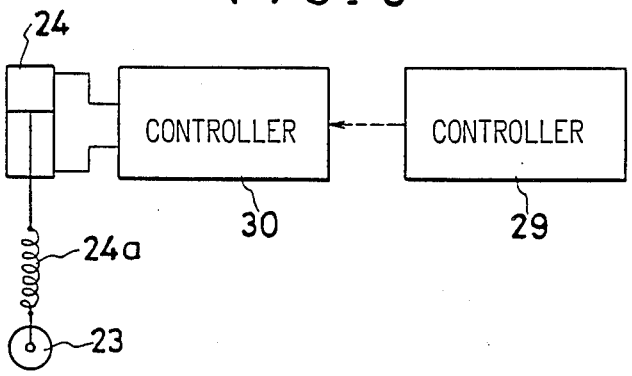
FIG. 8 is a shcematic representation of a second embodiment of the dancer roller drive control mechanism.

In the example of FIG. 8, the dancer roller drive control mechanism 24 is a hydraulic cylinder, and the spring **24*a* is provided between the cylinder and dancer roller 23. The controller 30 comprises a servo valve, and the point of coupling between the spring 24*a* and the hydraulic cylinder 24 is displaced to the required height from the reference position of the dancer roller by the hydraulic cylinder 24. When the stem of the spring 24*a* is moved upwards or downwards, the spring is elongated or contracted. However, since the reaction force to the elongation or contraction of the spring is known, the gravitational force acting on the dancer roller 23 and the fittings thereon minus or plus the reaction force serves as the force applied to the dancer roller 23** against the tension in the stretched sheet, i.e., the force tending to cause displacement of the dancer roller in the direction of increasing the length of the running path of the stretched sheet.

Figure 9:
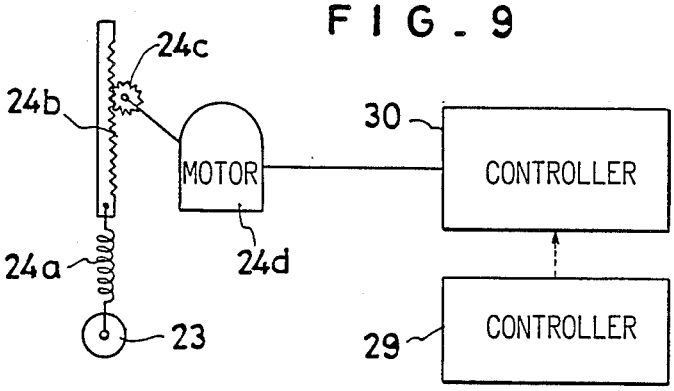
FIG. 9 is a schematic representation of a third example of the dancer roller drive control mechanism.

In the example of FIG. 9, the dancer roller drive control mechanism 24 includes a motor **24*d*, a spring 24*a*, rack 24*b* and a pinion 24*c*. The controller 30 consists of a servo amplifier. The rack and pinion may be replaced with a screw jack. This example, unlike the example of FIG. 8**, is simple in construction, and can be used where leakage of oil would be a major problem.

Figure 10:
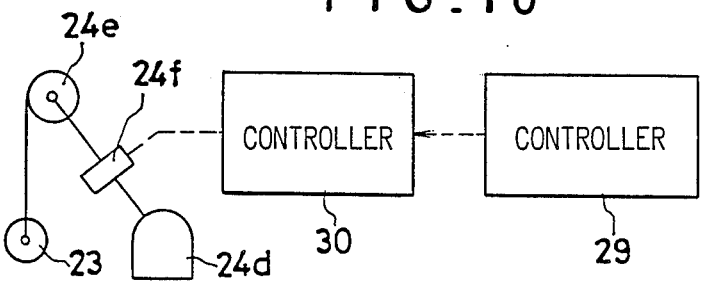
FIG. 10 is a schematic representation of a fourth example of the dancer roller drive control mechanism.

In the example of FIG. 10, the drive control mechanism 24 includes a winch mechanism **24*e*, a motor 24*d* and a friction clutch 24*f*, e.g., a magnetic powder clutch which is provided between the motor and the winch mechanism and is capable of providing continuous slip. The controller 30 is an amplifier which converts the output signal from the controller 29** to a current or voltage of the magnitude required for producing a desired transmission torque in the friction clutch.

With this construction, as in the example of FIG. 7, it is possible to maintain constant thrust of the dancer roller against the running sheet irrespective of the movement of the dancer roller.

Figure 11:
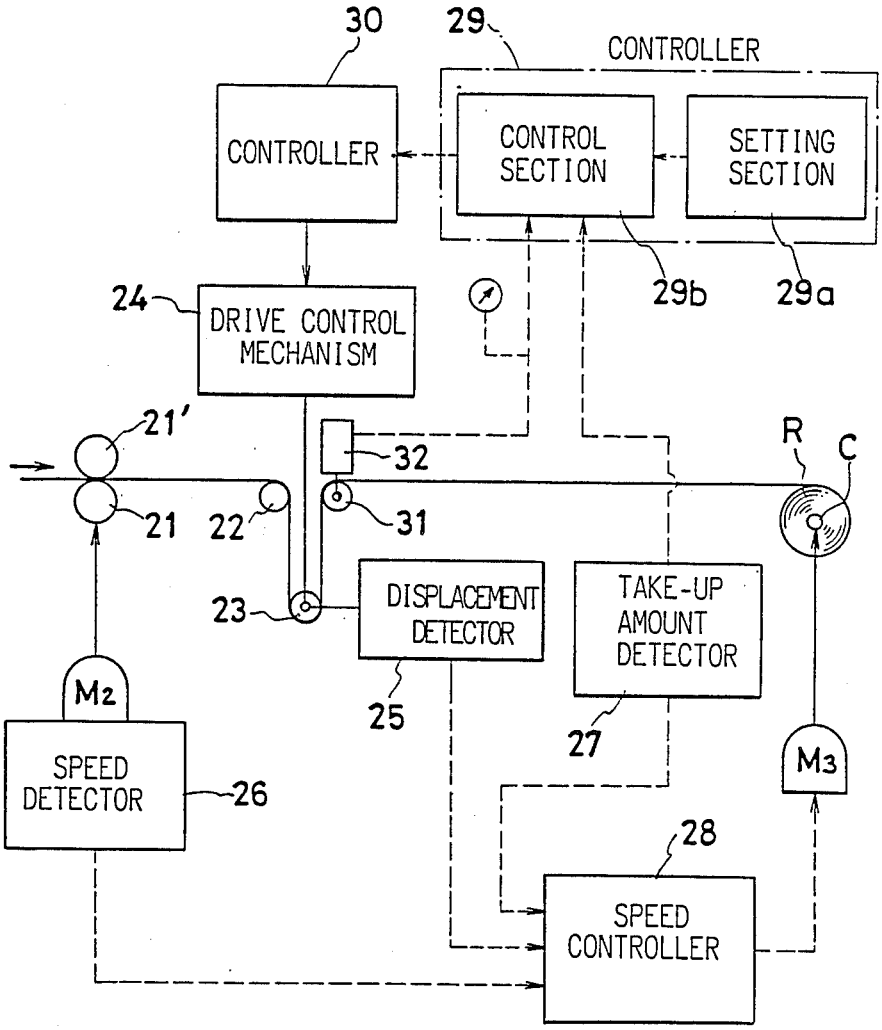
FIG. 11 is a schematic representation of a second embodiment of the take-up tension control apparatus.

FIG. 11 shows a second embodiment of the take-up tension control apparatus. In this embodiment, the load acting on a tension detection roller 31 due to the tension in the stretched sheet is converted by a load detector 32 into an electric signal representing the take-up tension in the stretched sheet.

The take-up tension signal is fed back to a control section 29*b* of a controller 29 for comparison with a calculated take-up tension signal obtained from the amount signal. The take-up tension is thus controlled through feedback control such that the detected take-up tension coincides with the preset take-up tension at all times.

Figure 12:
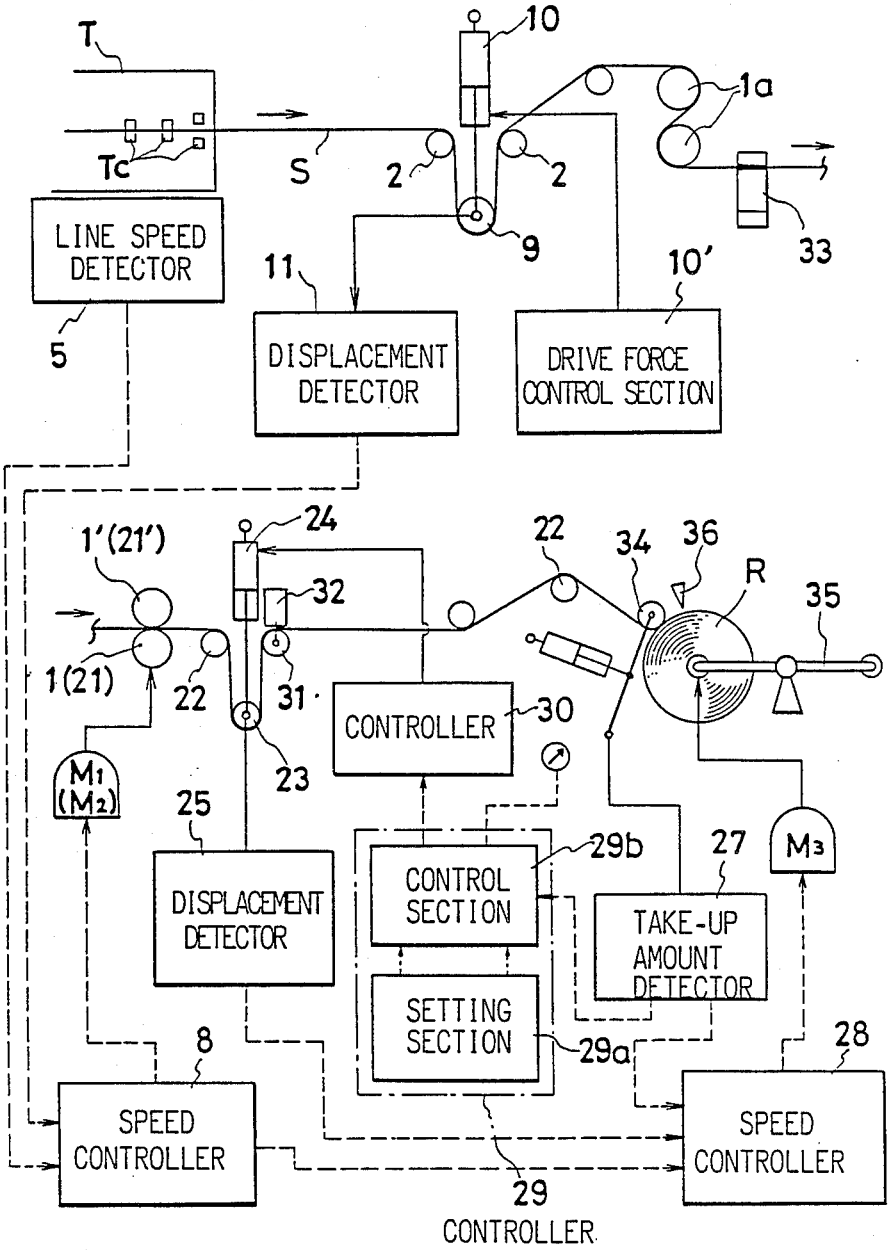
FIG. 12 is a schematic representation of an in-line winder with a take-out tension control apparatus and a take-up tension control apparatus according to the invention.
Figure 13:
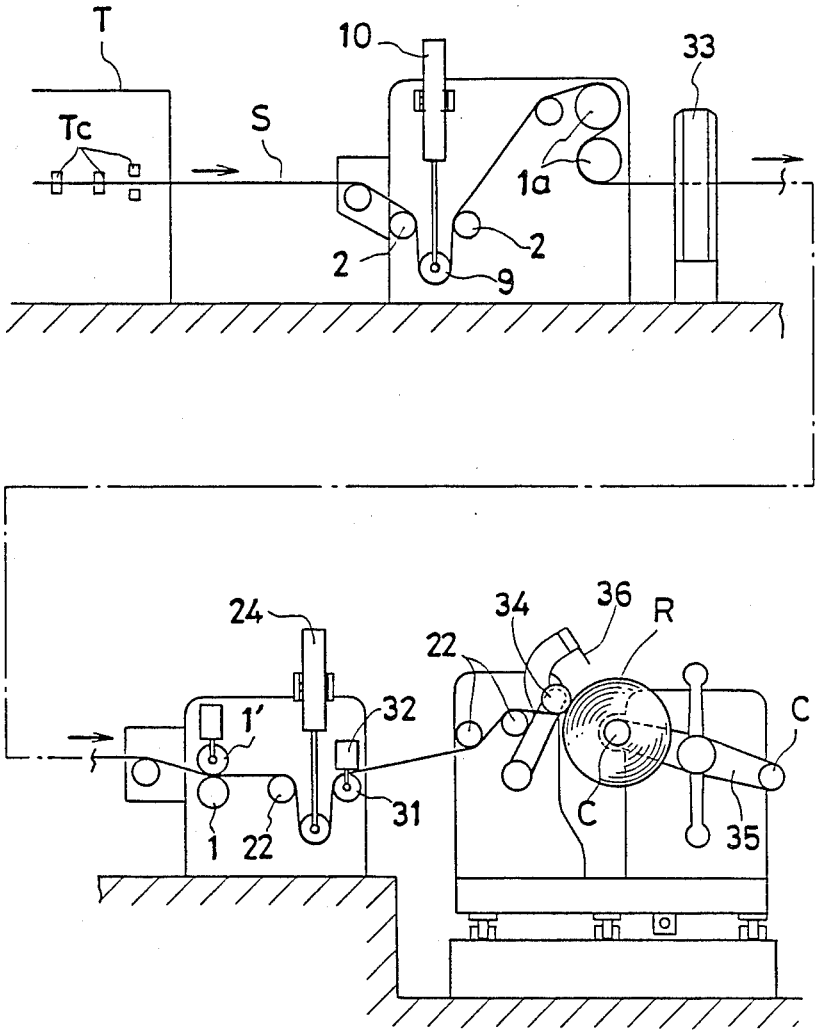
FIG. 13 is a schematic side view showing the in-line winder shown in FIG. 12.

FIGS. 12 and 13 show an in-line winder in which the take-out tension control apparatus shown in FIG. 5 and the take-up tension control apparatus shown in FIG. 6 are connected together. The take-out roller 1 also serves as the feed roller 21 in this case.

The stretched sheet S fed out from the stretching unit T proceeds round a dancer roller 9 which serves as the take-out tension controller, cooling rollers 1*a*, a thickness gauge 33, a take-out roller 1, a dancer roller 23 which serves as the take-up controller and a touch roller 34 to be wound into a roll R on a take-up reel C of a take-up unit. In this embodiment the take-up roller also serves as the feed roller and the stretched sheet running speed signal fed to the speed controller 28 for providing a speed command signal commanding the speed of the take-up reel drive motor M3 is constituted by the speed command signal for commanding the speed of the take-out roller drive motor M1 provided from the speed controller 8. It is alternatively possible to provide a separate line speed detector for detecting the running speed of the line.

In this embodiment, a turret arm 35 is provided at opposite ends with respective take-up reel C for discharging finished rolls of the stretched sheet alternately from the two take-up reels C. When the completed roll R comes to the discharge position, the trailing end of the rolled sheet of the roll is cut by a cutter 36. The new leading end of the stretched sheet is automatically wound on the new take-up reel brought to the take-up position. A touch roller 34 is brought into rolling contact with the new take-up reel C, and the stretched sheet is taken up while air introduced between adjacent turns of the roll R being wound is controlled. When a predetermined length of the rolled sheet has been wound, the roll R thus produced is brought to the discharge position, followed by the cutting of the trailing end of the rolled sheet and the winding of the new leading end of the rolled sheet on a new take-up reel, the completed roll being discharged during this time. The above sequence of operations is repreated to produce the roll of stretched sheet continuously.

With the above in-line winder, both the effects of take-out tension control by the take-out tension control apparatus and the take-up tension control by the take-up tension control apparatus can be obtained. In addition, the take-out roller 1 and take-up reel C are rotated so as to accurately follow the line speed of the rolling unit T, so that the take-out tension and take-up tension in the stretched sheet fed out from the rolling unit T are independently controlled to proper values and the stretched sheet can be taken out from the stretched sheet production line without sacrifice of quality. Thus, even a very thin sheet or a wide sheet measuring 5 to 6 m or more in width can be taken out under uniform tension, so that it is possible to improve the quality and yield of the stretched sheet rolls produced.

What is claimed is:

1. A take-out tension control apparatus for controlling tension in a film or sheet fed out from a stretching device for stretching a film or sheet to a predetermined thickness, said take-out tension control apparatus comprising:
   - a take-out roller for taking out the film or sheet from the stretching device;
   - a motor for driving said take-out roller;
   - a dancer roller interposed between the stretching device and said take-out roller and thrust against tension in the film or sheet in the direction of increasing the length of a path on which the film or sheet runs;
   - means for controlling the thrust acting on said dancer roller;
   - displacement detecting means for detecting displacement of said dancer roller and issuing a detected displacement signal; and
   - a speed controller for receiving said displacement signal and controlling the drive speed of said motor on the basis of said displacement signal so as to put said dancer roller at a predetermined position.

2. A take-out tension control apparatus according to claim 1, further comprising a speed detector for detecting a line speed of the stretching device, said speed detector and said speed controller controlling the drive speed of said motor in conjunction with each other on the basis of a line speed value detected by said speed detector and a displacement signal detected by said displacement detecting means.

3. A take-out tension control apparatus according to claim 1, further comprising winding tension control means for supplying the film or sheet taken out by said take-out roller to a rewinder while controlling winding tension in the film or sheet.

4. A take-out tension control apparatus according to claim 1, wherein said means for controlling the thrust comprises a pneumatic cylinder and an electropneumatic converter.

5. A take-out tension control apparatus according to claim 1, wherein said means for controlling the thrust comprises a fluid pressure cylinder and a regulator valve for operating said fluid pressure cylinder.

6. A take-out tension control apparatus according to claim 1, wherein said means for controlling the thrust comprises an oil pressure cylinder and a spring.

7. A take-out tension control apparatus according to claim 1, wherein said means for controlling the thrust comprises a rack, a pinion, a spring and a motor for driving said pinion.

8. A take-out tension control apparatus according to claim 1, wherein said means for controlling the thrust comprises a winch mechanism, a motor and a friction clutch interposed between said winch mechanism and said motor

* * * * *